US008777434B2

(12) United States Patent
Van Beek et al.

(10) Patent No.: US 8,777,434 B2
(45) Date of Patent: Jul. 15, 2014

(54) REFRIGERATOR WITH EXTERNALLY MOUNTED LIGHTING

(75) Inventors: Jacco Van Beek, Breda (NL); Wilco Wessels, Ulvenhout (NL)

(73) Assignee: Thetford Corporation, Ann Arbor, MI (US)

( * ) Notice: Subject to any disclaimer, the term of this patent is extended or adjusted under 35 U.S.C. 154(b) by 0 days.

(21) Appl. No.: 13/571,503

(22) Filed: Aug. 10, 2012

(65) Prior Publication Data

US 2013/0050984 A1 Feb. 28, 2013

Related U.S. Application Data

(60) Provisional application No. 61/527,676, filed on Aug. 26, 2011.

(51) Int. Cl.
*F25D 27/00* (2006.01)

(52) U.S. Cl.
USPC ..... 362/92; 362/94; 62/264

(58) Field of Classification Search
USPC ..... 362/92, 94, 253, 234, 154, 155; 62/264
See application file for complete search history.

(56) References Cited

U.S. PATENT DOCUMENTS

| | | | | |
|---|---|---|---|---|
| 2,153,851 A | | 4/1939 | Swedman | |
| 2,339,085 A | | 1/1944 | Lukiesh | |
| 2,644,882 A | * | 7/1953 | Voda | 362/94 |
| 3,612,848 A | | 10/1971 | Koch et al. | |
| 5,873,646 A | * | 2/1999 | Fjaestad et al. | 362/92 |
| 7,050,888 B2 | | 5/2006 | Schneider et al. | |
| 2009/0021927 A1 | | 1/2009 | Hall et al. | |
| 2011/0203302 A1 | | 8/2011 | Alberghetti et al. | |

FOREIGN PATENT DOCUMENTS

| | | | |
|---|---|---|---|
| DE | 2055691 A1 | | 5/1972 |
| DE | 202005011279 U1 | | 9/2006 |
| EP | 0813034 A2 | | 12/1997 |
| JP | 5-133679 | * | 5/1993 |
| JP | 2003185336 A | | 7/2003 |
| WO | 2008025642 A2 | | 3/2008 |
| WO | 2008087028 A2 | | 7/2008 |

OTHER PUBLICATIONS

Extended European Search Report regarding Application No. EP12005922.5, dated Jan. 7, 2013.
European Search Report regarding Application No. EP12005922.5, dated Dec. 20, 2012.

* cited by examiner

*Primary Examiner* — Laura Tso
(74) *Attorney, Agent, or Firm* — Harness, Dickey & Pierce, P.L.C.

(57) ABSTRACT

A refrigerator constructed in accordance to one example of the present disclosure includes a cabinet that defines an interior volume. A first door is coupled to the cabinet and is movable between a closed position and an open position. A light is disposed on the cabinet outside of the interior volume. The light is configured to illuminate when the door is in the open position and shine light toward the interior volume.

14 Claims, 8 Drawing Sheets

REFRIGERATOR WITH EXTERNALLY MOUNTED LIGHTING

CROSS-REFERENCE TO RELATED APPLICATIONS

This application claims priority to U.S. Provisional Patent Application No. 61/527,676 filed 28 Aug. 2011, which application is herein expressly incorporated by reference.

FIELD

The present disclosure relates generally to refrigerators and, more particularly, to a lighting arrangement and related method for illuminating an interior space of a refrigerator.

BACKGROUND

This section merely provides background information related to the present disclosure and may not constitute prior art.

Vehicles, including but not limited to, recreational vehicles ("RVs", in the United States and "Caravans" in Europe), tractor trailers, airplanes, boats, trains and the like, often incorporate refrigerators for the comfort and convenience of the occupants. For example, recreational vehicle campers often find it convenient, or even necessary, to refrigerate food, drinks, and medicine during their journey and while at their campsites. While many prepared camp sites in parks and commercial campgrounds provide for electrical outlets, many do not. Moreover, many highly desirable camping locations exist outside of these prepared sites. Thus, a popular solution has been to equip the recreational vehicle with an absorption refrigerator.

Absorption refrigerators typically employ heat to vaporize a coolant-water mixture (typically ammonia-water) thereby driving the refrigeration loop in a manner well known to those skilled in the art. Popular heat sources include electrical heaters and fuel burners. The fuel burners typically employ propane which is readily available at camping supply stores, barbeque supply stores, and numerous gas stations. Though, any liquid or gaseous fuel would work well and be controllable through simple, automated control systems.

Some absorption refrigerators incorporate internal lighting that is configured to illuminate, such as when a door of the refrigerator opens. However, in some configurations, the interior of the refrigerator may have objects, such as the internal components of the refrigerator or contents of the refrigerator that can obstruct the light illumination. In these examples, the light intensity may be unsatisfactory for a user to ascertain the contents of the refrigerator.

SUMMARY

This section provides a general summary of the disclosure, and is not a comprehensive disclosure of its full scope or all of its features.

A refrigerator constructed in accordance to one example of the present disclosure includes a cabinet that defines an interior volume. A first door is coupled to the cabinet and is movable between a closed position and an open position. A light is disposed on the cabinet outside of the interior volume. The light is configured to illuminate when the door is in the open position and shine light toward the interior volume.

According to other features, the first door is hingedly coupled to the cabinet. The interior volume comprises a first interior volume section and a second interior volume section.

A second door is coupled to the cabinet and movable between a closed position and an open position. The first interior volume is accessible through the first door and the second interior volume is accessible through the second door. The light is disposed at a location intermediate the first and second door on the cabinet. A switch communicates a signal to a controller in response to the first door being moved to the open position. The controller communicates a signal to illuminate the light.

Further areas of applicability will become apparent from the description provided herein. The description and specific examples in this summary are intended for purposes of illustration only and are not intended to limit the scope of the present disclosure.

DRAWINGS

The present teachings will become more fully understood from the detailed description, any appended claims and the following drawings. The drawings are for illustrative purposes only and are not intended to limit the scope of the present disclosure.

Corresponding reference numerals indicate corresponding parts throughout the several views of the drawings.

DETAILED DESCRIPTION

Figure 1:
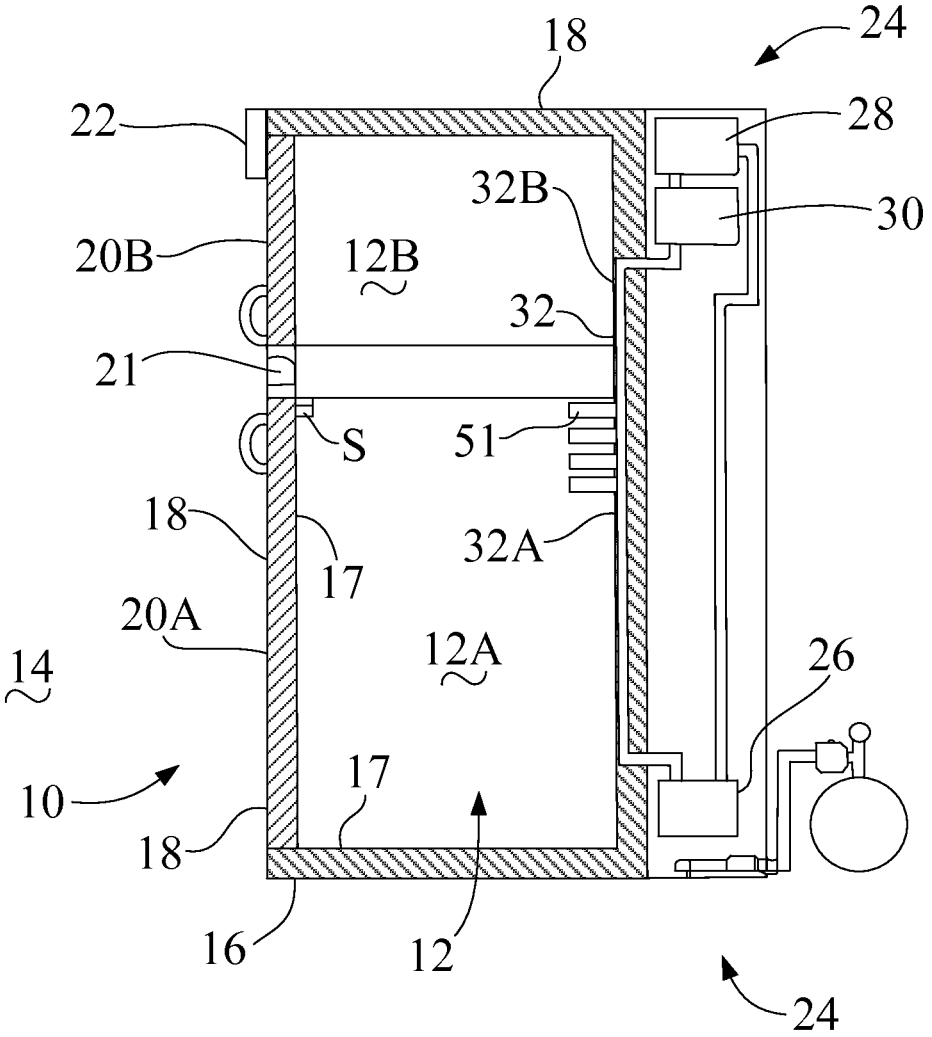
FIG. 1 is a cross-sectional side view of an absorption refrigerator incorporating a light configuration according to one example of the present teachings.

The following description is merely exemplary in nature and is not intended to limit the present disclosure, its application, or uses. It should be understood that throughout the drawings, corresponding reference numerals indicate like or corresponding parts and features.

The devices, methods and systems described herein can be applied to a wide variety of cooling units. For the purpose of illustration though, a typical absorption refrigeration system is used that has a cold storage compartment. Those skilled in the art will understand that the illustrative refrigeration system does not limit the present teachings in any way, but is used only to explain the present teachings.

With initial reference to FIG. 1, an absorption refrigerator constructed in accordance with one example of the present teachings is shown and generally identified at reference numeral 10. The refrigerator 10 conventionally includes an interior volume 12 in which a user desires to store perishables and other items needing cooling. The interior volume 12 may be defined by a cabinet 16 that is divided into two, or more, sections 12A and 12B with one section preferentially being kept cooler than the other interior section. The cabinet 16 provides protection for the various components of the refrigerator 10. The cabinet 16 can include inner and outer liners 17 and 18, respectively that help prevent warm air intrusion into the interior 12 and prevent cold air seepage from the interior 12. The outer liner 18 can include an insulating layer (such as fiberglass) limits heat conduction into the interior 12 from the exterior 14.

A first door 20A allows the user access to the first section 12A of the interior volume 12. A second door 20B allows the user access to the second section 12B of the interior volume 12. The doors 20A and 20B also can include a portion of the insulation 18. A light 21 is disposed on the cabinet 16 outside the interior volume 12 and is configured to illuminate towards the first section 12A of the interior volume 12 when the first door 20A opens as will be described more fully herein. The light 21 is shown and described as being disposed generally on the cabinet 16. It will be appreciated however that the light 21 may be mounted to a supplemental feature such as a front projection, a bracket, a hinge, a mounting plate or other structure that positions the light 21 outside of the interior volume 12. In some examples, the front projection may be positioned intermediate the first and second doors 20A and 20B.

A switch S is disposed on the refrigerator 10 such as on the cabinet 16. The switch S can be conventional in nature and be arranged to have a first portion that moves relative to a second portion. The first portion can be configured to move with the first door 20A while the second portion remains statically mounted to the cabinet 16 (or other static portion) of the refrigerator 10. The switch S is configured to send a signal to a controller indicating that the first door 20A has been opened. As will become appreciated from the following discussion, the light 21 is configured to illuminate upon the first door 20A opening to shine light toward the first section 12A of the interior volume 12 of the refrigerator 10. The light 21 can be any type of light emitting device such as, but not limited to, an incandescent lamp, electroluminescent lamp, or gas discharge lamp.

Figure 2:
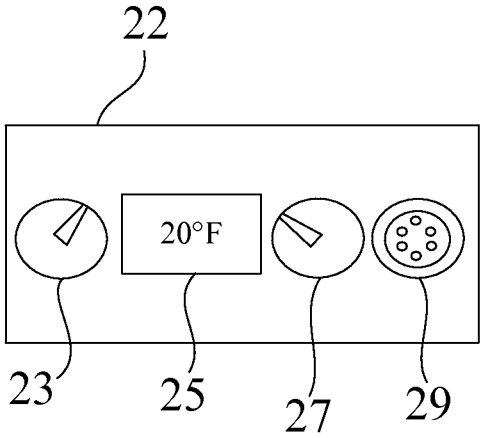
FIG. 2 is a front view of an exemplary control panel on the absorption refrigerator of FIG. 1.

With additional reference now to FIG. 2, a control panel 22 is provided on the refrigerator 10 so that the user can turn the refrigerator 10 on and off, adjust the temperature of one or more interior sections, and monitor the performance of the refrigerator 10. Controls for these functions are provided such as an on/off switch 23, a temperature indicator 25, and a temperature set point selector 27 as shown in FIG. 2. The control panel 22 can also include a refrigeration monitor 29 to allow the user to determine whether the refrigerator is operating properly.

The refrigerator 10 also includes an absorption refrigeration system 24. As far as the present disclosure is concerned, the absorption refrigeration system 24 is conventional in construction and operation. Briefly, the absorption system 24 includes a generator 26, a condenser 28, a receiver 30, and an evaporator 32 arranged in a loop. In the generator 26, the coolant mixture (typically ammonia and water-anhydrous ammonia) absorbs heat thereby preferentially releasing ammonia vapor. From the generator 26, the ammonia vapor flows to the condenser 28. In the condenser 28, the ammonia vapor cools and condenses. Outside air driven by a fan may be employed to provide the heat transfer necessary to condense the vapor in the condenser 28. By gravity, the cool liquid ammonia flows from the condenser 28 and into the receiver 30.

From the receiver 30, the liquid ammonia bleeds through an orifice (not shown) into the evaporator 32. In the evaporator 32, the liquid ammonia absorbs heat from the interior 12 thereby cooling the interior 12. The flow of ammonia to the evaporator 30 may be controlled by a control valve rather than the orifice described above, thus providing closed loop control of the temperature in the interior 12. The vaporized ammonia then flows from the evaporator 32 to the generator 26 wherein the partially depleted water-ammonia mixture absorbs the ammonia vapor to complete the refrigeration cycle. The evaporator 32 may include one or more cooling fins 51 for increasing the efficiency of removing heat from the interior volume 12. Other arrangements of the evaporator 32 may be provided without departing from the present disclosure. Additional description of components and operation of the absorption refrigeration system 24 may be found in U.S. Pat. No. 7,050,888, which is expressly incorporated herein by reference.

Figure 3:
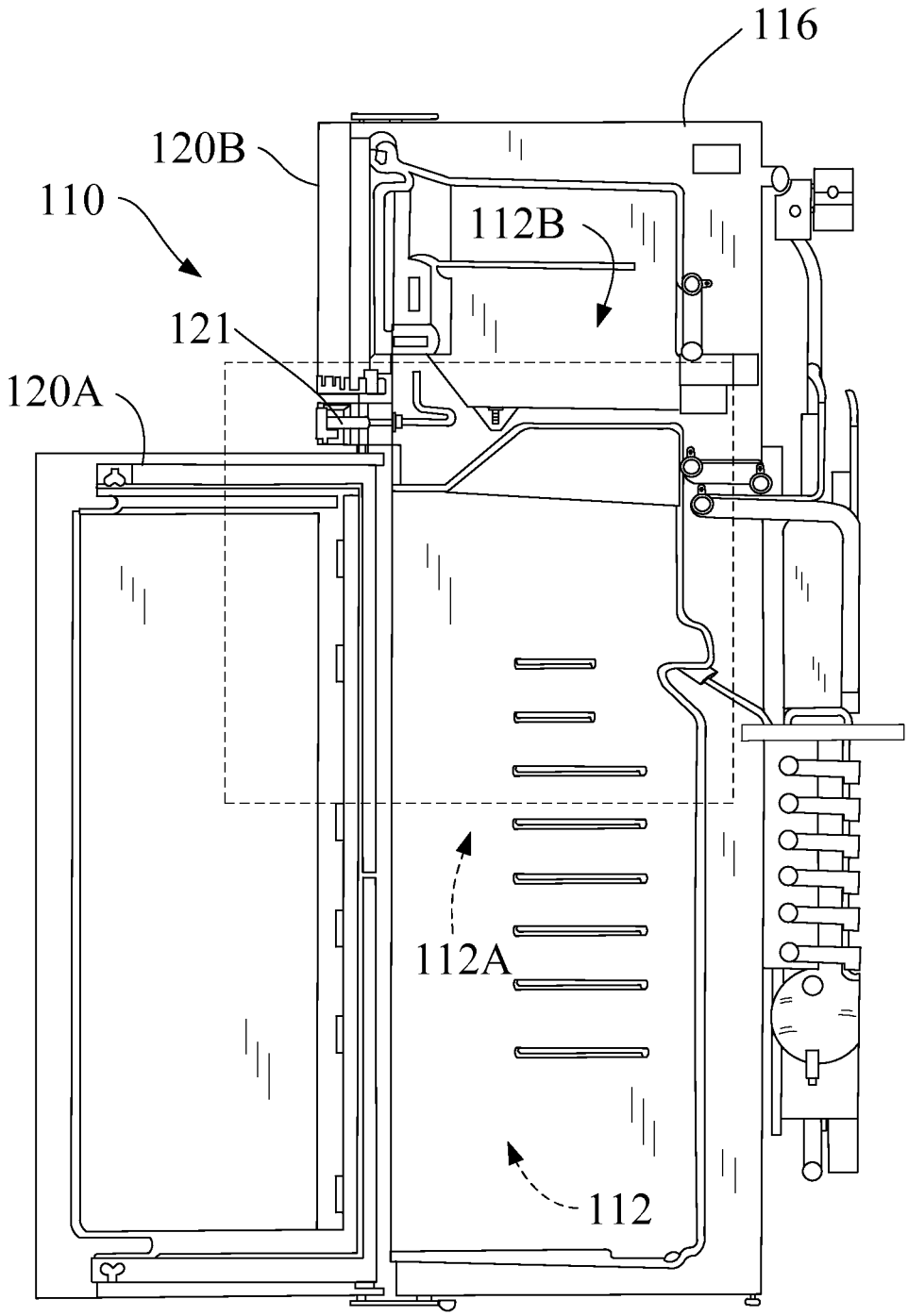
FIG. 3 is a side view of another absorption refrigerator incorporating a light configuration according to another example of the present teachings.
Figure 4:
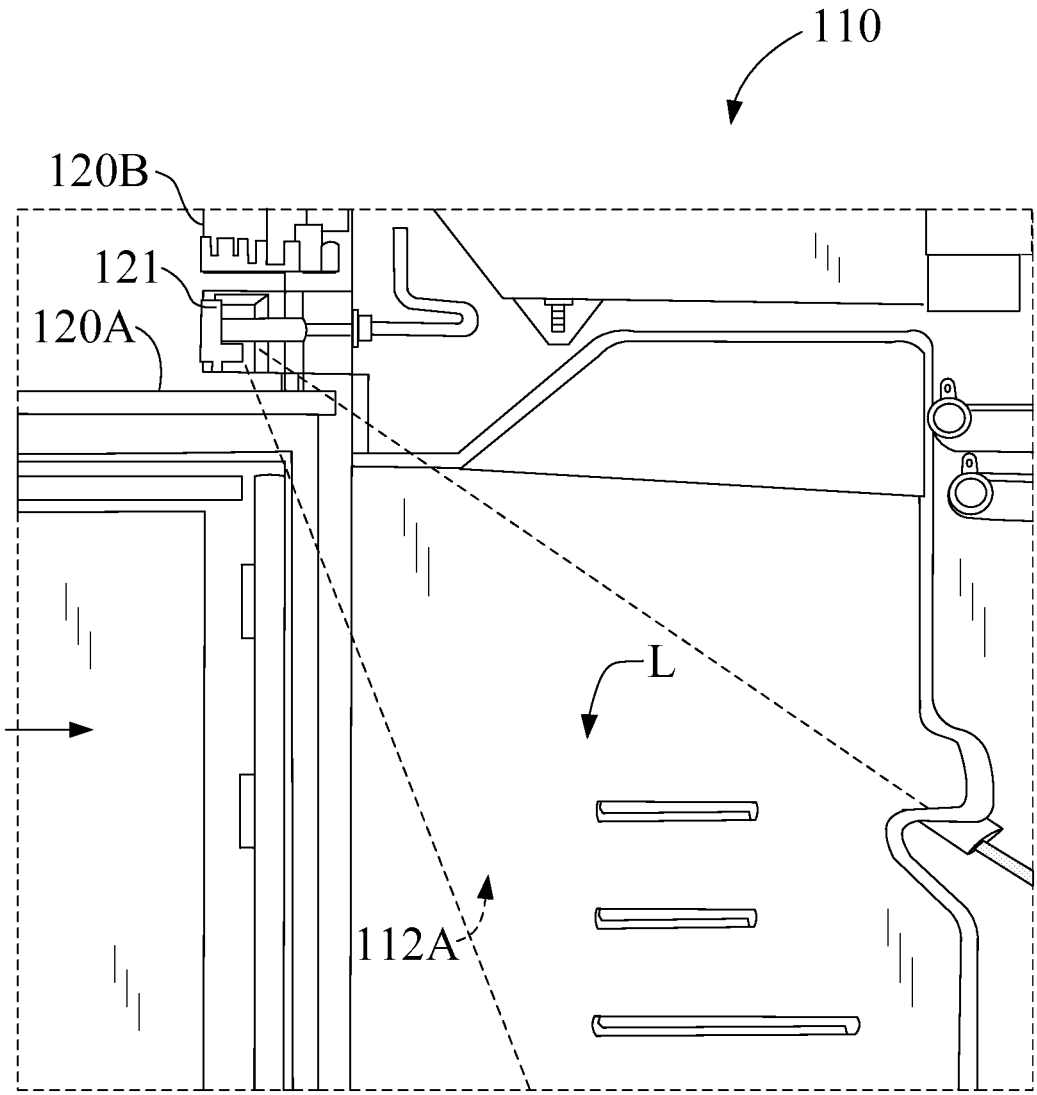
FIG. 4 is an enlarged close-up view of the light shown with a light output illuminating an interior of the refrigerator illustrated in FIG. 3 according to one example.

With reference now to FIGS. 3 and 4, another absorption refrigerator constructed in accordance to additional features of the present teachings is shown and generally identified at reference numeral 110. The absorption refrigerator 110 can include similar refrigeration components as discussed above with respect to the refrigeration system 24. The refrigerator 110 includes an interior volume 112. The interior volume may be defined by a cabinet 116 that may be divided into a first interior section 112A and a second interior section 112B. The cabinet 116 provides protection for the various components of the refrigerator 110. A light 121 can be disposed on the cabinet 116.

The refrigerator 110 includes a first door 120A that allows access to the first interior section 112A. A second door 120B allows user access to the second interior section 112B. A switch S can be configured on the refrigerator 110 to communicate a signal indicative of the first door 120A being open as will be described. When the switch S communicates the signal indicative of the first door 120A being open, the light 121 is illuminated as shown in FIG. 4. In this regard, the light 121 shines light L toward the first interior section 112A. While the present description has been directed toward illuminating the first interior section 112A, the light 121 can be configured to additionally or alternatively illuminate the second interior section 112B upon opening of the second door 120B. In other examples, a second dedicated light may be incorporated for illuminating the second interior section 112A from a location outside the interior volume 112.

Figure 5:
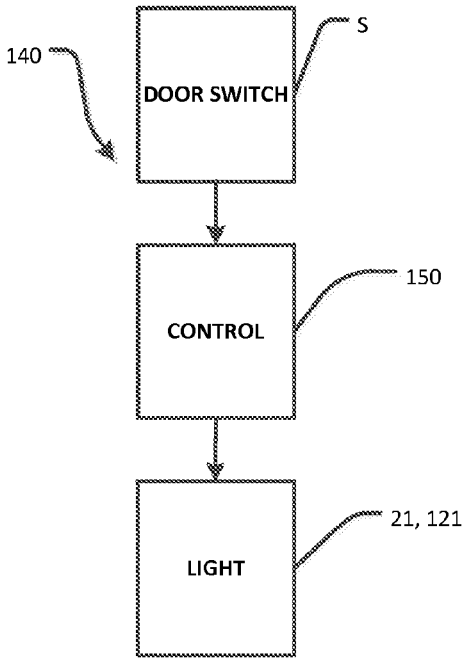
FIG. 5 is an exemplary schematic representation of a control system that controls the light according to one example of the present teachings.

Turning now to FIG. 5, an exemplary control system 140 that incorporates features of the present disclosure is shown. The control system 140 can generally include a controller 150 that receives a signal from the door switch S and outputs a signal to the light 21, 121 in response thereto.

Figure 6:
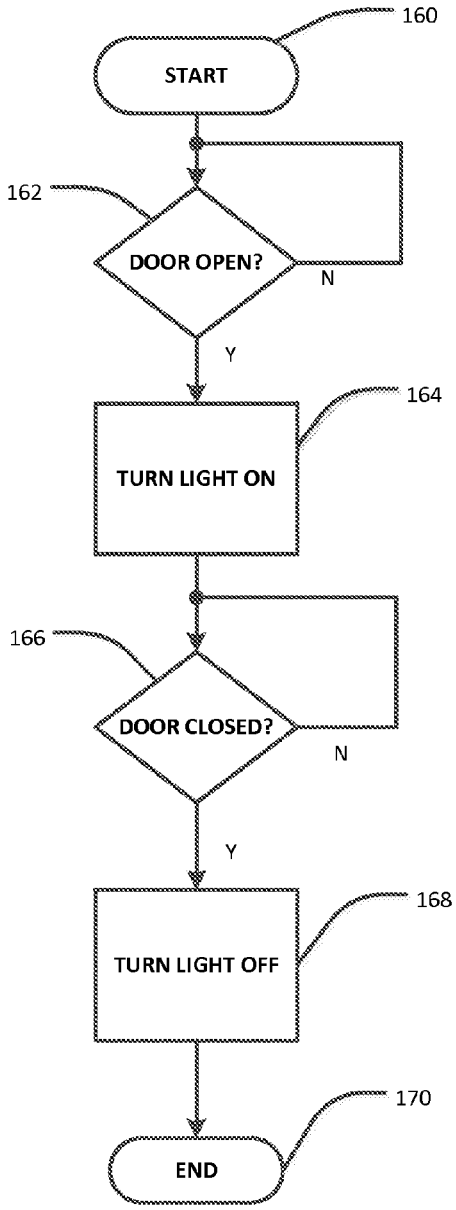
FIG. 6 is a flow-chart illustrating a method, in accordance with the principles of the present disclosure of illuminating the light.
Figure 7:
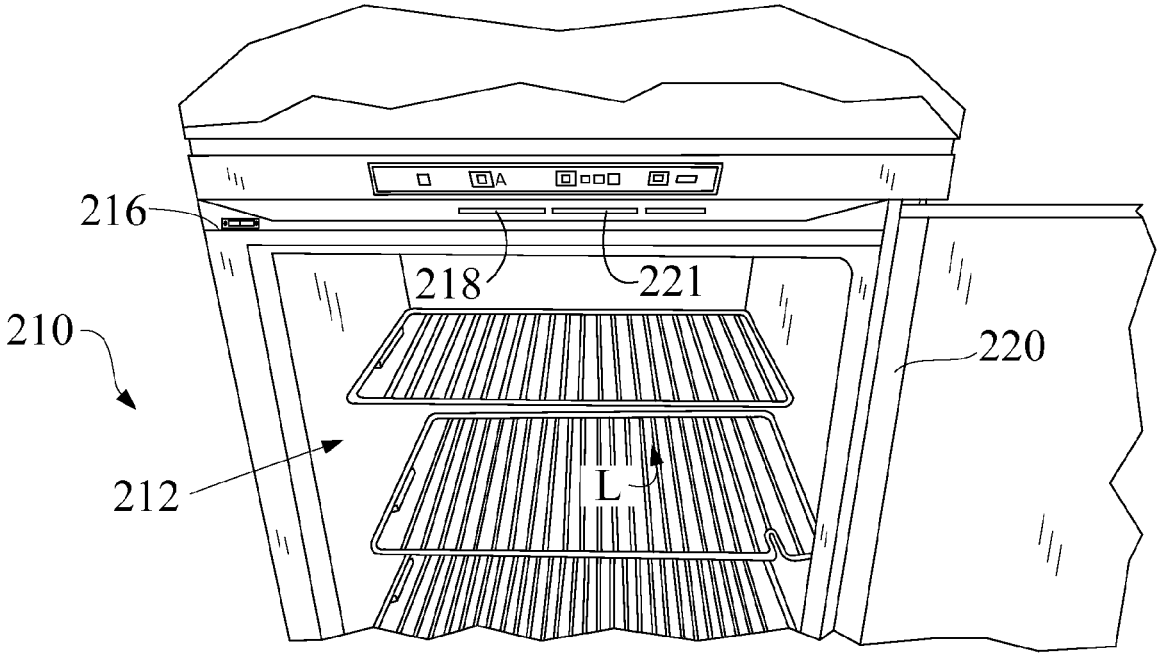
FIG. 7 is a front perspective view of another absorption refrigerator incorporating a light configuration according to another example of the present teachings and shown with a front door open.
Figure 8:
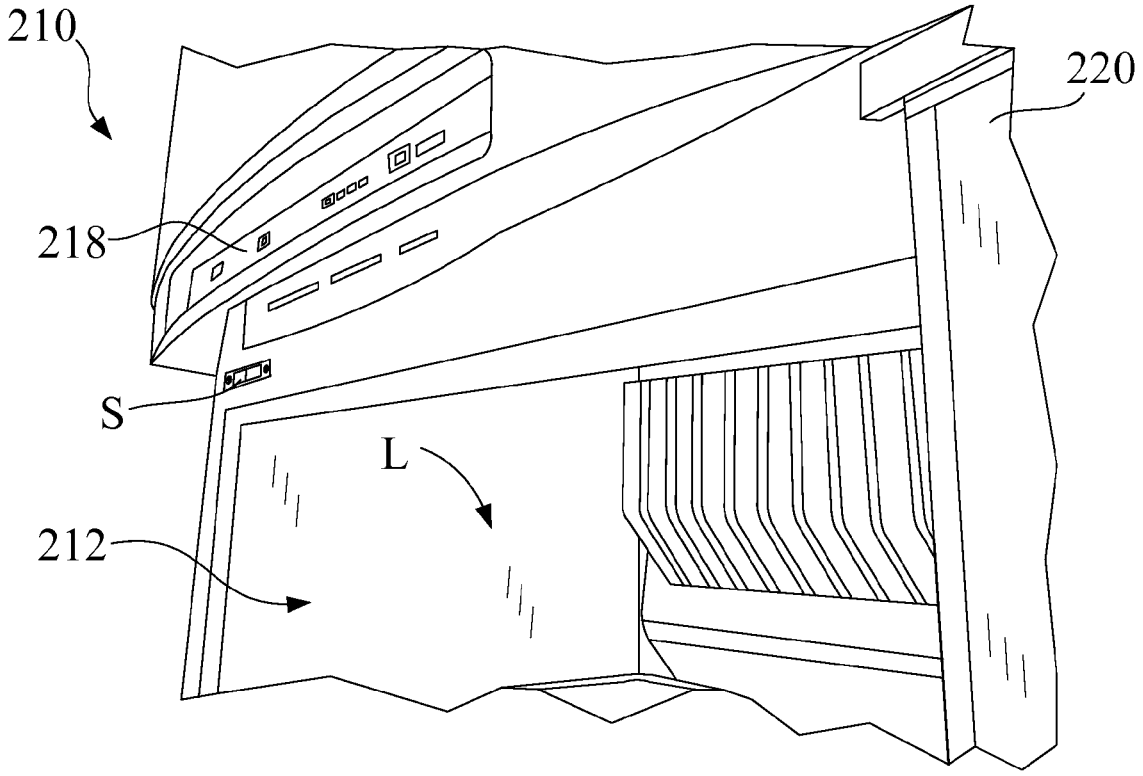
FIG. 8 is a right perspective view of the absorption refrigerator of FIG. 7 and shown with a front door open.
Figure 9:
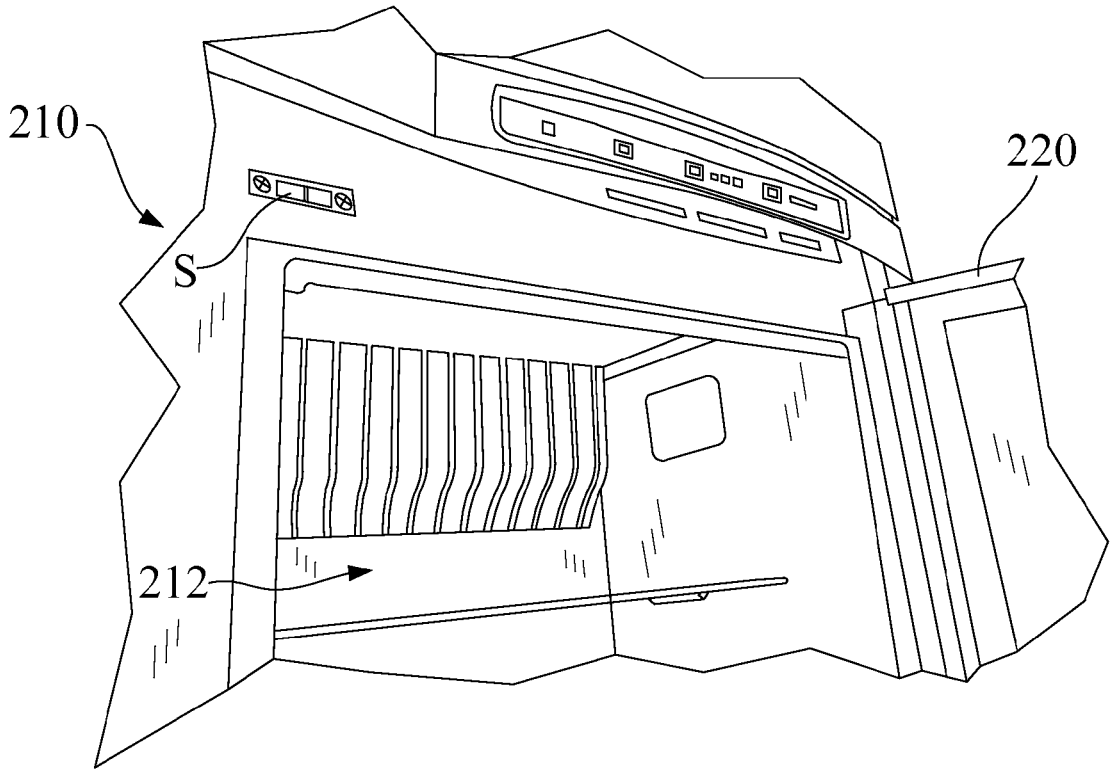
FIG. 9 is a left perspective view of the absorption refrigerator of FIG. 7 and shown with a front door open.
Figure 10:
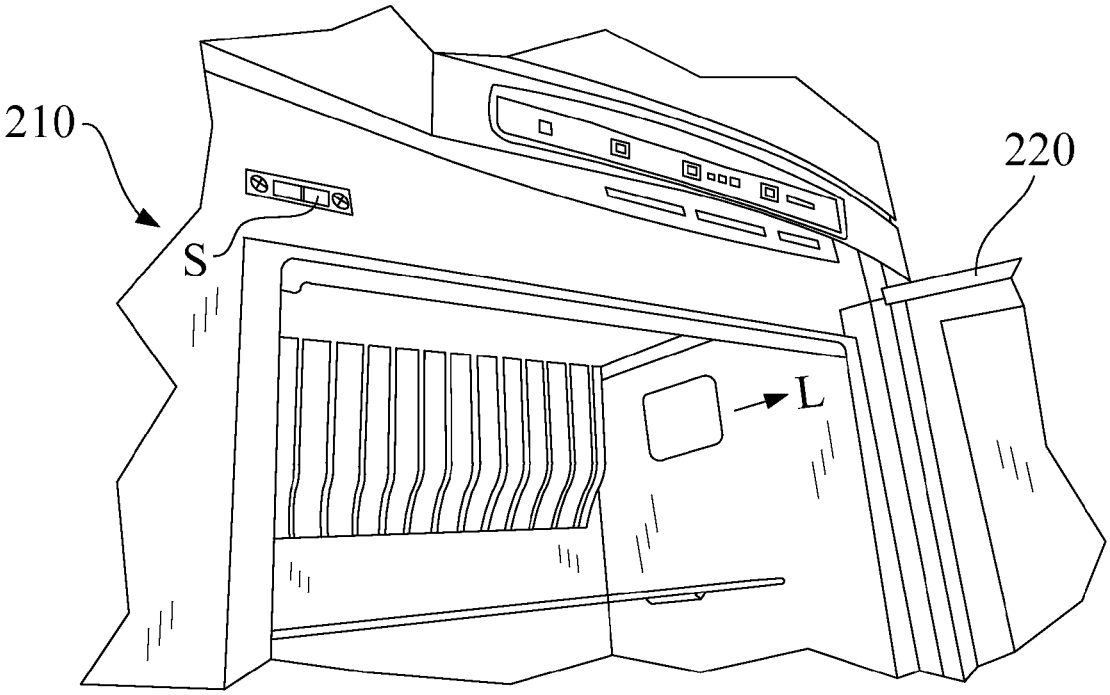
FIG. 10 is another left perspective view of the absorption refrigerator of FIG. 7 and shown with a front door open.

Turning now to FIG. 6, an exemplary method of operating the control system 140 of FIG. 5 is shown. Control starts in step 160. In step 162, control determines if the door 20A, 120A is open. If the door 20A, 120A, is not open, control loops to step 162. If the door 20A, 120A is open, control turns the light 21, 121 on in step 164. In step 166, control determines if the door 20A, 120A has closed. If the door 20A, 120A has not closed, control loops to step 166. If the door 20A, 120A has closed, control turns the light 21, 121 off in step 168. Control then ends in step 170.

With reference now to FIGS. 7-10, another absorption refrigerator constructed in accordance to additional features of the present teachings is shown and generally identified at reference numeral 210. The absorption refrigerator 210 can include similar refrigeration components as discussed above with respect to the refrigeration system 24. The refrigerator 210 includes an interior volume 212. The interior volume 212 is defined by a cabinet 216 that provides protection for the various components of the refrigerator 210. A light 221 can be disposed on the cabinet 216. More specifically, the light 221 can be disposed on a front projection 218 of the refrigerator 210. The front projection 218 may include a control panel. In some examples, the front projection 218 may be arranged between first and second front doors such as described above. The refrigerator 210 includes a door 220 that allows access to the interior volume 212. A switch S can be configured on the refrigerator 110 to communicate a signal indicative of the door 220 being open as discussed above. When the switch S communicates the signal indicative of the door 220 being open, the light 221 is illuminated as shown. In this regard, the light 221 shines light L from a position outside the interior volume 212 in a direction toward the interior volume 212.

While specific examples have been discussed in the specification and illustrated in the drawings, it will be understood by those skilled in the art that various changes may be made and equivalence may be substituted for elements thereof without departing from the scope of the present teachings. For example, while the light 21, 121 and 221 has been described for use with an absorption refrigerator 10, 110 and 210 having a particular configuration, the light 21, 121 and 221 can be configured for use with any absorption refrigerator. Furthermore, the mixing and matching of features, elements and/or functions between various examples may be expressly contemplated herein so that one skilled in the art would appreciate from the present teachings that features, elements and/or functions of one example may be incorporated into another example as appropriate, unless discussed otherwise above. Moreover, many modifications may be made to adapt a particular situation or material to the present teachings without departing from the essential scope thereof. Therefore, it may be intended that the present teachings not be limited to the particular examples illustrated by the drawings and discussed in the specification as the best mode of presently contemplated for carrying out the present teachings but that the scope of the present disclosure will include any embodiments following within the foregoing description and any appended claims.

What is claimed is:

1. A refrigerator comprising:

a cabinet that defines an interior volume;

a first door coupled to the cabinet and movable between a closed position and an open position;

a projection extending forwardly from the cabinet in a direction generally away from the interior volume; and a light disposed on the projection and located outside the interior volume, the light configured to illuminate the interior volume when the door is in the open position and shine light directly toward the interior volume.

2. The refrigerator of claim 1 wherein the first door is hingedly coupled to the cabinet.

3. The refrigerator of claim 2 wherein the interior volume comprises a first interior volume section and a second interior volume section.

4. The refrigerator of claim 3, further comprising a second door that is coupled to the cabinet and movable between a closed position and an open position, wherein the first interior volume is accessible through the first door and the second interior volume is accessible through the second door.

5. The refrigerator of claim 4 wherein the light is disposed at a location intermediate the first and second door.

6. The refrigerator of claim 1, further comprising a switch that communicates a signal to a controller in response to the first door being moved to the open position, wherein the controller responsively communicates a signal to illuminate the light.

7. The refrigerator of claim 1 wherein the refrigerator is an absorption refrigerator.

8. A refrigerator comprising:

a cabinet that defines an interior volume;

a first door coupled to the cabinet and movable between a closed position and an open position;

a front projection arranged on the refrigerator, the front projection extending forwardly from the cabinet in a direction generally away from the interior volume, the front projection including a control panel for controlling operational features of the refrigerator; and a light disposed on the front projection at a location outside the interior volume and that is configured to directly illuminate the interior volume when the door is in the open position and shine light toward the interior volume.

9. The refrigerator of claim 1, wherein the projection extends from the cabinet without extending into the interior volume such that the interior volume is open immediately adjacent the projection.

10. The refrigerator of claim 4, wherein the projection is positioned immediately between the first and second doors.

11. The refrigerator of claim 8, wherein the projection extends from the cabinet without extending into the interior volume such that the interior volume is open immediately adjacent the projection.

12. The refrigerator of claim 11, further comprising a second door that is coupled to the cabinet and movable between a closed position and an open position, wherein the first interior volume is accessible through the first door and the second interior volume is accessible through the second door.

13. The refrigerator of claim 12, wherein the projection is positioned immediately between the first and second doors.

14. The refrigerator of claim 11, wherein the front projection is disposed completely outside of the interior volume such that the interior volume.

* * * * *